US005553334A

United States Patent [19]

Hillman

[11] Patent Number: 5,553,334

[45] Date of Patent: Sep. 10, 1996

[54] TOILET DESIGNED TO FACILITATE BOWEL MOVEMENTS

[76] Inventor: Betty R. Hillman, 5750 Edmeston Dr., Fayetteville, N.C. 28311

[21] Appl. No.: 314,318

[22] Filed: Sep. 28, 1994

[51] Int. Cl.[6] ..... E03D 11/02

[52] U.S. Cl. ..... 4/420; 4/249; 4/254

[58] Field of Search ..... 4/237, 254, 249, 4/420

[56] References Cited

U.S. PATENT DOCUMENTS

| | | | |
|---|---|---|---|
| 532,656 | 1/1895 | Fryer | 4/420 |
| 1,155,885 | 10/1915 | Catchings | 4/254 X |
| 1,585,557 | 5/1926 | Miller | 4/249 |
| 4,466,140 | 8/1984 | Sakamoto | 4/254 |
| 4,713,846 | 12/1987 | Hodroski, Jr. | 4/254 |
| 5,027,445 | 7/1991 | Locarno | 4/254 X |

FOREIGN PATENT DOCUMENTS

| | | | |
|---|---|---|---|
| 0340599 | 2/1904 | France | 4/254 |
| 0611416 | 10/1960 | Italy | 4/254 |
| 0012782 | of 0000 | United Kingdom | 4/254 |
| 2039565 | 8/1980 | United Kingdom | 4/420 |
| 2215748 | 9/1989 | United Kingdom | 4/254 |

*Primary Examiner*—Robert M. Fetsuga

[57] ABSTRACT

It is an object of the present invention to provide a new and improved curved toilet bowl specifically adapted to protect a user's colon including a bowl having a first side, a second side, a forward portion, a rearward portion, and an oval upper opening having a forward extent and a rearward extent. The bowl further includes a lower base and a hollow interior. The oval upper opening slopes gradually upwardly from the rearward extent to forward extent. The upper opening also has a peripheral thickness which increases from the rearward extent to the forward extent. The forward extent of upper opening functions to support the knees and the underside of the upper legs of the user. The footrest has a top surface, an upwardly inclined forward portion, and a rearward portion. The rearward portion includes a recessed edge. The recessed edge is specifically adapted to be removably secured to the lower base of the bowl.

1 Claim, 4 Drawing Sheets

TOILET DESIGNED TO FACILITATE BOWEL MOVEMENTS

BACKGROUND OF THE INVENTION

1. Field of the Invention

The present invention relates to a toilet designed to facilitate bowel movements and more particularly pertains to a toilet bowl which causes a more natural position indusive to promoting more comfortable bowel movements.

2. Description of the Prior Art

The use of toilet bowls is known in the prior art. More specifically, toilet bowls heretofore devised and utilized for the purpose of disposing of waste are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,852,191 to Giglio discloses a toilet.

U.S. Pat. No. 3,504,381 to Dewey II discloses a toilet bowl.

Furthermore, U.S. Pat. Nos. Des. 342,778 to Chen, 331, 959 to Huang, and 311,242 to Reid all discloses toilets.

In this respect, the toilet designed to facilitate bowel movements according to the present invention substantially departs from the conventional concepts and designs of the prior art, and in doing so provides an apparatus primarily developed for the purpose of causing a more natural position indusive to promoting easier and more comfortable bowel movements.

Therefore, it can be appreciated that there exists a continuing need for a new and improved toilet designed to facilitate bowel movements which can be used for promoting easier and more comfortable bowel movements. In this regard, the present invention substantially fulfills this need.

SUMMARY OF THE INVENTION

In view of the foregoing disadvantages inherent in the known types of toilets now present in the prior art, the present invention provides an improved toilet designed to facilitate bowel movements. As such, the general purpose of the present invention, which will be described subsequently in greater detail, is to provide a new and improved toilet designed to facilitate bowel movements and method which has all the advantages of the prior art and none of the disadvantages.

To attain this, the present invention essentially comprises a toilet bowl which is specifically adapted to protect a user's colon. In its broadest context the present invention includes a bowl portion, a detachable foot rest and a foot pedal which is adapted to flush the toilet bowl. The bowl has a first side, a second side, a forward portion, a rearward portion, and an oval upper opening having a forward extent and a rearward extent. The bowl further includes a lower base and a hollow interior. The oval upper opening of the bowl is such that it gradually slopes upward from its rearward extent to its forward extent. The upper opening has a peripheral thickness which increases from the rearward extent to the forward extent. This upper opening may take the form of a pivotal lid which may be pivoted up or down. The function of the forward extent of the upper opening is to support the upper legs and knees of the user. The result is that of user of the toilet bowl is in more of a stooping position. This stooping position allows one to pass their stool more easily. Furthermore, this orientation lessens the strain on the users back and colon. The footrest has a top surface, an upwardly inclined forward portion, and a rearward portion. The rearward portion includes a recessed edge. This recessed edge is specifically adapted to be removably secured to the lower base of the bowl. The top surface of the upwardly inclined forward portion includes a right recessed foot area and a left recessed foot area. These recessed foot areas provide comfortable places for a user to rest his/her feet. The foot rest can be covered with a fabric or material which facilitates a user's comfort. The toilet bowl actuation lever has a first end, a second end and an intermediate extent. The first end of the lever is adapted to be pressed by a foot of the user of the toilet bowl. The actuation lever functions such that when the user presses the first end of the lever the second end of the lever effects flushing of the toilet bowl. Thus, the actuation lever provides an easy way for a user to effect flushing of the bowl. The toilet bowl can further include both a first hand rail and a second hand rail. The first hand rail has a front leg, a rear leg, and an intermediate handrail. The first hand rail is disposed on the first side of the bowl. The second hand rail has a front leg, a rear leg, and an intermediate handrail. The second hand rail is disposed on the second side of the bowl.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toilet designed to facilitate bowel movements which has all the advantages of the prior art toilets and none of the disadvantages.

It is another object of the present invention to provide a new and improved toilet designed to facilitate bowel movements which may be easily and efficiently manufactured and marketed.

It is further object of the present invention to provide a new and improved toilet designed to facilitate bowel movements which is of durable and reliable constructions.

An even further object of the present invention is to provide a new and improved toilet designed to facilitate bowel movements which is susceptible of a low cost of manufacture with regard to both materials and labor, and which accordingly is then susceptible of low prices of sale to the consuming public, thereby making such toilet designed to facilitate bowel movements economically available to the buying public.

Still yet another object of the present invention is to provide a new and improved toilet designed to facilitate bowel movements which provides in the apparatuses and methods of the prior art some of the advantages thereof, .while simultaneously overcoming some of the disadvantages normally associated therewith.

Even still another object of the present invention is to provide a toilet bowel which causes a more natural position indusive to promoting easier and more comfortable bowel movements.

Lastly, it is an object of the present invention to provide a new and improved curved toilet bowl specifically adapted to protect a user's colon including a bowl having a first side, a second side, a forward portion, a rearward portion, and an oval upper opening having a forward extent and a rearward extent. The bowl further includes a lower base and a hollow interior. The oval upper opening slopes gradually upwardly from the rearward extent to forward extent. The upper opening also has a peripheral thickness which increases from the rearward extent to the forward extent. The forward extent of upper opening functions to support the knees and the underside of the upper legs of the user. The footrest has a top surface, an upwardly inclined forward portion, and a rearward portion. The rearward portion includes a recessed edge, the recessed edge is specifically adapted to be removably secured to the lower base of the bowl.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
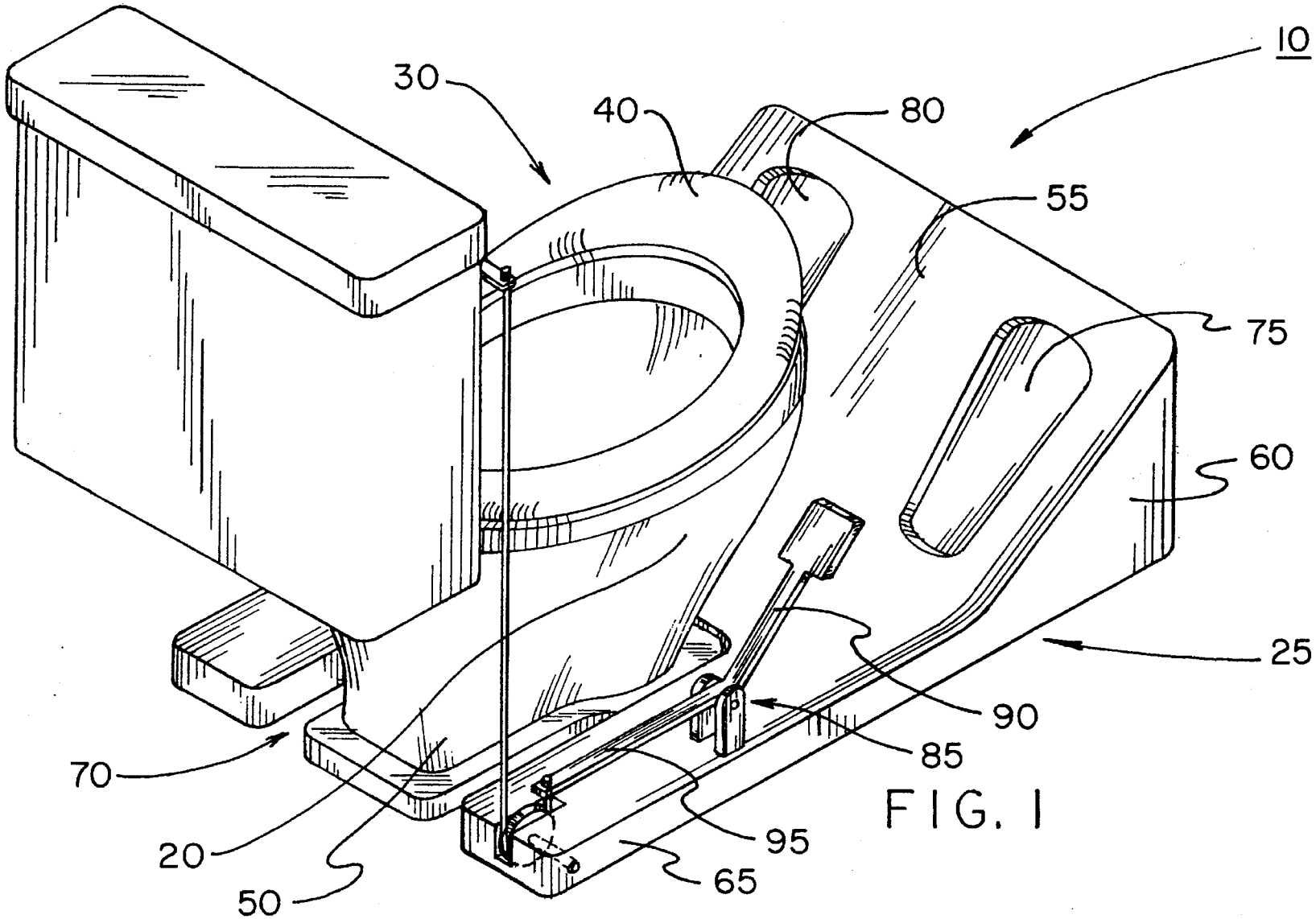
FIG. 1 is a perspective view of the preferred embodiment of the toilet designed to facilitate bowel movements constructed in accordance with the principles of the present invention.
Figure 2:
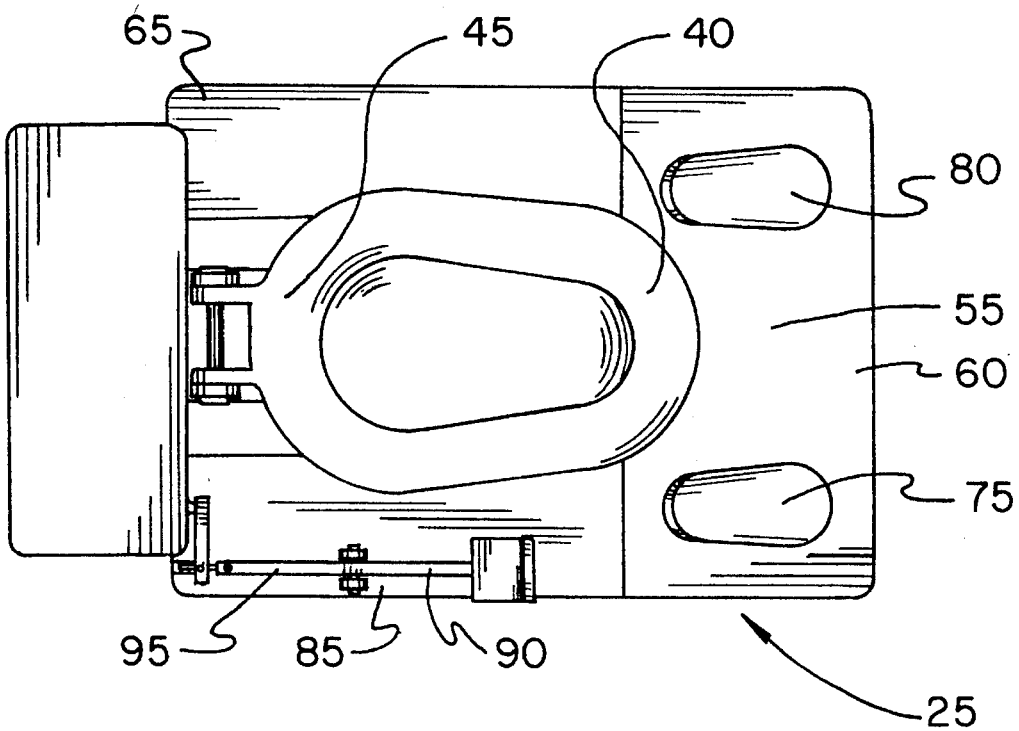
FIG. 2 is a plan view of the toilet bowl in accordance with the present invention.
Figure 3:
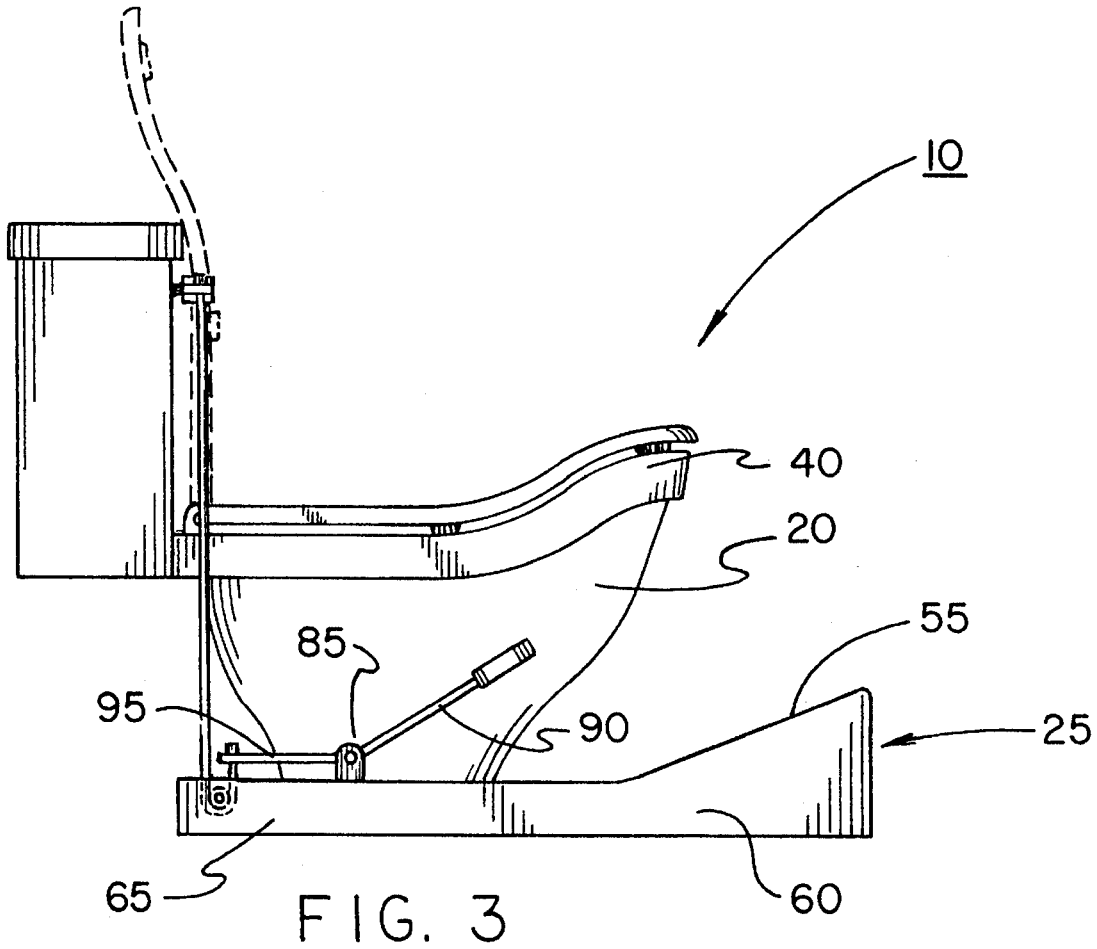
FIG. 3 is a side elevational view of the present invention.
Figure 4:
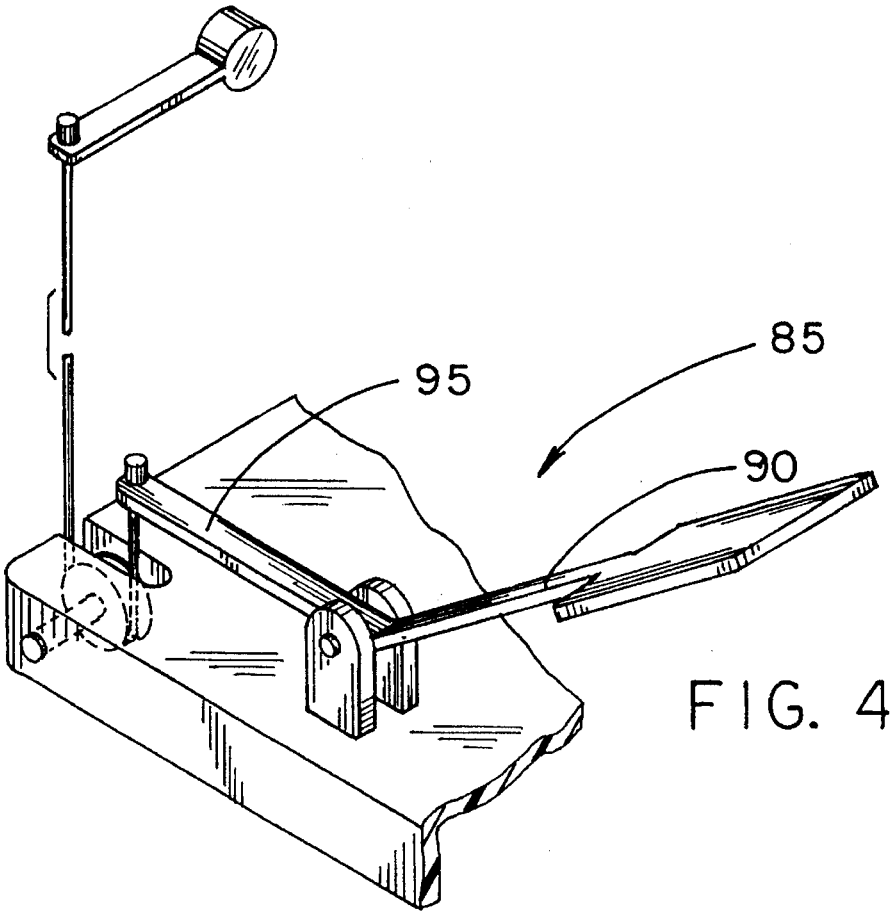
FIG. 4 is a view of the actuation lever in accordance with the present invention.
Figure 5:
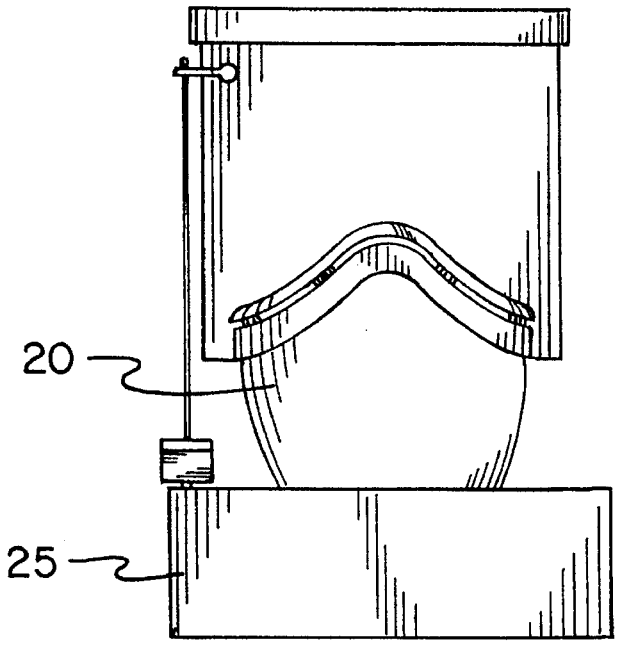
FIG. 5 is a front view of the toilet in accordance with the present invention.
Figure 6:
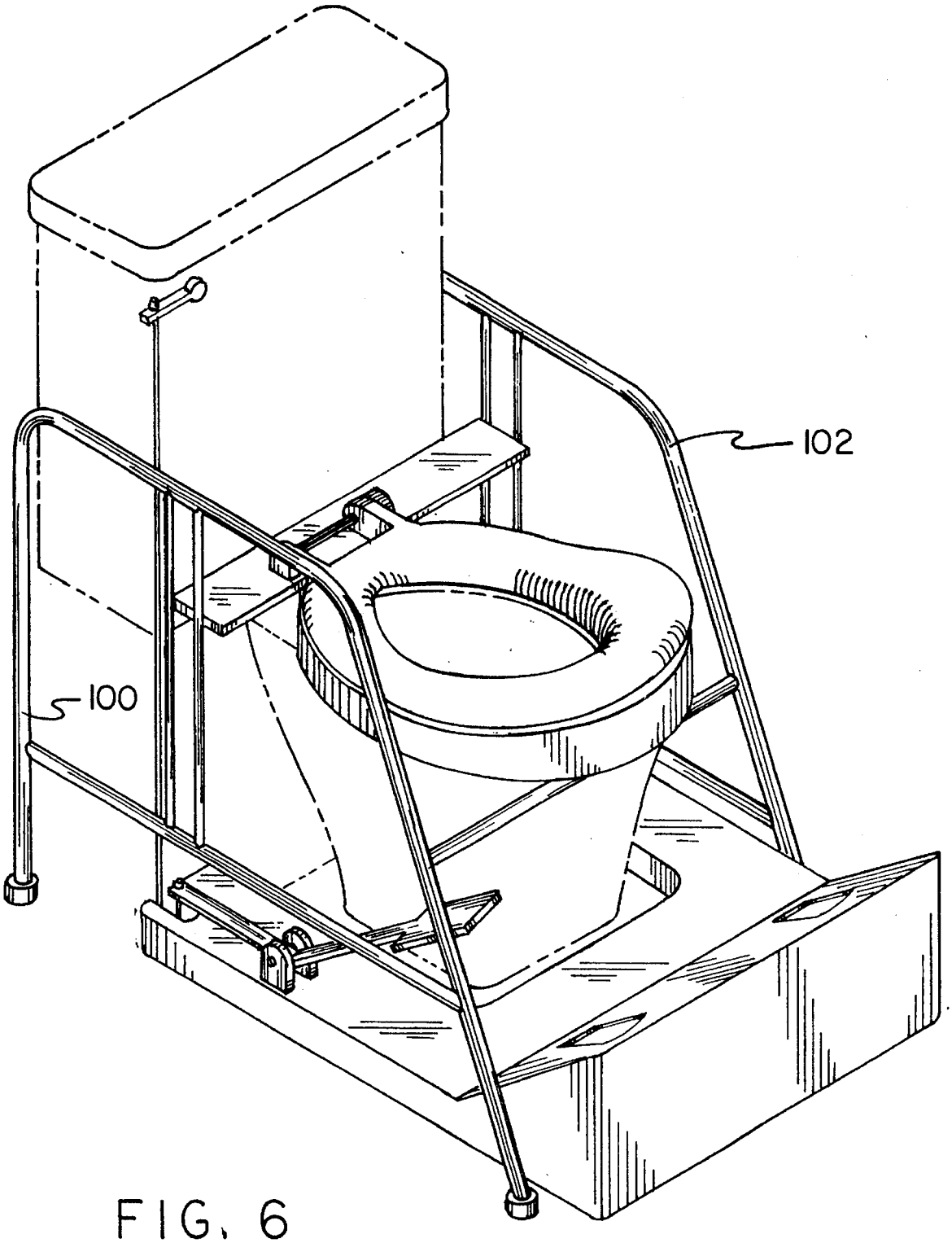
FIG. 6 is a embodiment of the toilet bowl which includes side hand rails.

With reference now to the drawings, and in particular to FIG. 1 thereof, the preferred embodiment of the new and improved toilet designed to facilitate bowel movements embodying the principles and concepts of the present invention and generally designated by the reference numeral 10 will be described.

The present invention relates to a toilet bowl which is specifically adapted to protect a user's colon. In its broadest context the present invention includes a bowl portion 20, a detachable foot rest 25 and a foot pedal which is adapted to flush the toilet bowl.

The bowl 20 has a first side, a second side, a forward portion, a rearward portion, and an oval upper opening 30 having a forward extent 40 and a rearward extent 45. The bowl 20 further includes a lower base 50 and a hollow interior. The oval upper opening 30 of the bowl 20 is such that it gradually slopes upward from its rearward extent 45 to its forward extent 40. The upper opening 30 has a peripheral thickness which increases from the rearward extent 45 to the forward extent 40. This upper opening 30 may take the form of a pivotal lid which may be pivoted up or down. The function of the forward extent of the upper opening is to support the upper legs and knees of the user. The result is that of user a the toilet bowl is in more of a stooping position. This stooping position allows one to pass their stool more easily. Furthermore, this orientation lessens the strain on the users back and colon.

The footrest 25 has a top surface 55, an upwardly inclined forward portion 60, and a rearward portion 65. The rearward portion 65 includes a recessed edge 70. This recessed edge 70 is specifically adapted to be removably secured to the lower base 50 of the bowl 20. The top surface 55 of the upwardly inclined forward portion 60 includes a right recessed foot area 75 and a left recessed foot area 80. These recessed foot areas 75, 80 provide comfortable places for a user to rest his/her feet. The foot rest 25 can be covered with a fabric or material which facilitates a user's comfort.

The toilet bowl actuation lever 85 has a first end 90, a second end 95 and an intermediate extent. The first end 90 of the lever 85 is adapted to be pressed by a foot of the user of the toilet bowl. The intermediate extent is secured to the rearward portion 65 of the foot rest 25. The actuation lever 85 functions such that when the user presses the first end 90 of the lever the second end 95 of the lever effects flushing of the toilet bowl. Thus, the actuation lever 85 provides an easy way for a user to effect flushing of the bowl.

The toilet bowl can further include both a first hand rail 100 and a second hand rail 102. The first hand rail 100 is U-shaped and has a front leg, a rear leg, and an intermediate handrail. The first hand rail is disposed on the first side of the bowl. The second hand rail 102 is U-shaped and has a front leg, a rear leg, and an intermediate handrail. The second hand rail 102 is disposed on the second side of the bowl.

Thus, the above described is a special toilet that is designed to cause a more natural position indusive to promoting easier and more comfortable bowl movements, especially for people with back problems. It resembles a standard toilet except for some obvious differences. The water closet and bowl are positioned in the normal orientation with respect to each other, but the top of the bowl has been curved up on the front side to provide a support for the legs. A footrest is integrated into the base of the bowl and can be detached for comfortable positioning. The flusher is positioned on the floor so it may be activated by stepping on it. The toilet is employed in the normal flushing. Unlike existing toilets, the legs are supported to create a stooping position which is more natural, and tends to line up the colon, decreasing stress and stain on itself and on the back. The feet are supported on the footrest at the bottom to permit the person to relax, while also permitting proper blood circulation to the lower extremities. When finished, it is a simple matter to depress the flusher control with one foot. The whole bowl is designed to facilitate bowel movements and make the experience more comfortable by aligning the colon in a stooping position. This takes the pressure off the person's back. The device could be used in nursing homes, hospitals, rehabilitation centers, and in private homes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved curved toilet bowl specifically adapted to protect a user's colon comprising, in combination:

a bowl having a fist side, a second side, a forward portion, a rearward portion, and an oval upper opening having a forward extent and a rearward extent, the bowl further including a lower base and a hollow interior, the oval upper opening gradually sloping upwardly from the rearward extent to the forward extent, the upper opening having a peripheral thickness which increases from the rearward extent to the forward extent, the forward extent of the upper opening functioning to support the knees and the underside of the upper legs of the user;

a footrest having a top surface, an upwardly inclined forward portion, and a rearward portion, the rearward portion including a recessed edge, the recessed edge specifically adapted to be removably secured to the lower base of the bowl, the top surface of the upwardly inclined forward portion including a right recessed foot area and a left recessed foot area;

a toilet bowl actuation lever having a first end, a second end and an intermediate extent therebetween, the first end of the lever is adapted to be pressed by a foot of the user of the toilet bowl, the intermediate extent being secured to the rearward portion of the footrest, the actuation lever functions such that when the user presses the first end of the lever the second end of the lever effects flushing of the toilet bowl;

a U-shaped first hand rail having a front leg, a rear leg, and an intermediate handrail extending therebetween, the U-shaped hand rail secured on the first side of the bowl and a U-shaped second hand rail having a front leg, a rear leg, and an intermediate handrail extending therebetween, the U-shaped second hand rail secured on the second side of the bowl.

* * * * *